US009734817B1

(12) United States Patent
Putrycz

(10) Patent No.: US 9,734,817 B1
(45) Date of Patent: Aug. 15, 2017

(54) TEXT-TO-SPEECH TASK SCHEDULING

(71) Applicant: Amazon Technologies, Inc., Reno, NV (US)

(72) Inventor: Bartosz Putrycz, Gdansk (PL)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 206 days.

(21) Appl. No.: 14/221,985

(22) Filed: Mar. 21, 2014

(51) Int. Cl.
*G10L 13/00* (2006.01)
*G10L 13/08* (2013.01)

(52) U.S. Cl.
CPC ..... *G10L 13/00* (2013.01)

(58) Field of Classification Search
None
See application file for complete search history.

(56) References Cited

U.S. PATENT DOCUMENTS 6,466,909 B1 * 10/2002 Didcock ..... G10L 13/047 704/258
6,604,075 B1 * 8/2003 Brown ..... H04M 3/4938 704/270.1
RE42,904 E * 11/2011 Stephens, Jr. ..... H04M 3/4938 704/258
9,213,574 B2 * 12/2015 Faruquie ..... G06F 9/50
2006/0184626 A1 * 8/2006 Agapi et al. ..... 709/205
2006/0248214 A1 * 11/2006 Jackson ..... H04L 65/4084 709/231
2007/0094029 A1 * 4/2007 Saito et al. ..... 704/260
2008/0141180 A1 * 6/2008 Reed ..... G06F 17/30017 715/854
2011/0280390 A1 * 11/2011 Lawson ..... G06F 9/5077 379/220.01
2013/0129068 A1 * 5/2013 Lawson ..... H04M 3/00 379/242
2013/0297468 A1 * 11/2013 Hirsch ..... G06Q 40/00 705/32
2014/0082680 A1 * 3/2014 Hashi ..... H04N 21/438 725/94
2014/0122060 A1 * 5/2014 Kaszczuk ..... G10L 13/04 704/9

* cited by examiner

*Primary Examiner* — Marivelisse Santiago Cordero
*Assistant Examiner* — Kevin Ky
(74) *Attorney, Agent, or Firm* — Pierce Atwood LLP

(57) ABSTRACT

To prioritize the processing text-to-speech (TTS) tasks, a TTS system may determine, for each task, an amount of time prior to the task reaching underrun, that is the time before the synthesized speech output to a user catches up to the time since a TTS task was originated. The TTS system may also prioritize tasks to reduce the amount of time between when a user submits a TTS request and when results are delivered to the user. When prioritizing tasks, such as allocating resources to existing tasks or accepting new tasks, the TTS system may prioritize tasks with the lowest amount of time prior to underrun and/or tasks with the longest time prior to delivery of first results.

21 Claims, 8 Drawing Sheets

P14007

TEXT-TO-SPEECH TASK SCHEDULING

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Figure 1:
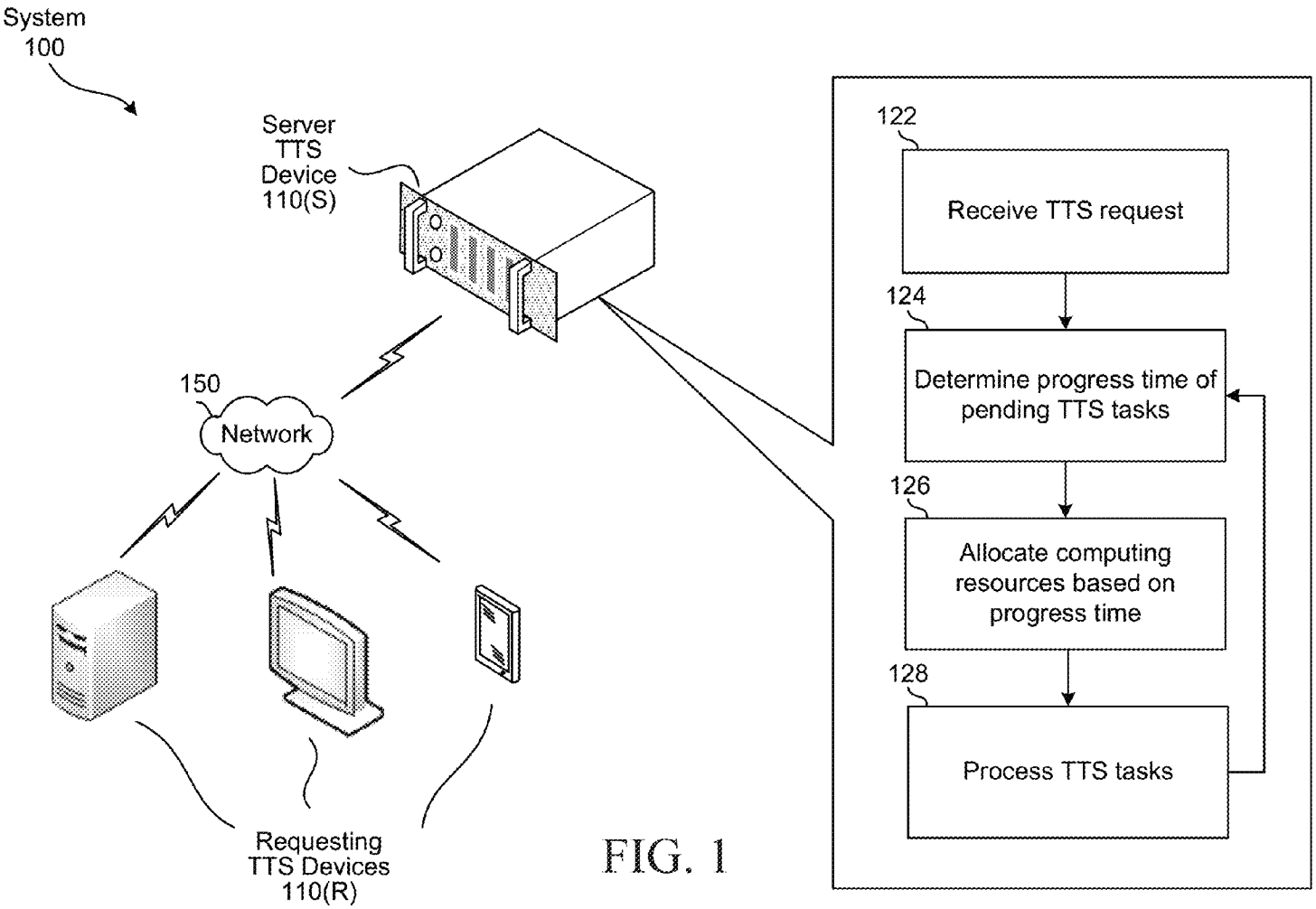
FIG. 1 illustrates allocating resources to TTS tasks according to one aspect of the present disclosure.

Text-to-speech (TTS) processing may involve a distributed system where a user initiates a TTS request at a local device that then sends portions of the request to a remote device, such as a server, for further TTS processing. The remote device may then process the request and return results to the user's local device to be accessed by the user.

While performing distributed TTS processing allows a system to take advantage of the high processing power of remote devices, such as powerful servers, such a system may result in a noticeable delay between when a user submits a TTS request (also called a TTS task) and when speech results begin to be available to the user. This delay is sometimes referred to as "time to first byte", thus representing the time it takes to deliver a first portion of speech results to a user. This delay may be the result of multiple factors, including the time for transporting data back and forth between a local device and a remote device, the time for pre-processing of a TTS request prior to actual speech synthesis and other factors. As this initial time period may be the most time and computationally intensive, once early TTS results become available (such as speech corresponding to the beginning of the text of a TTS request), there is often no further delay noticeable by a user. This is because once initial results have been computed and delivered, a TTS system can typically process continuing results faster than the user listens to the resulting speech. That is, it is faster for a TTS system to create synthesized speech than it is for a user to actually listen to the synthesized speech (assuming a normal speech playback speed).

TTS servers, however, often are tasked with processing multiple tasks simultaneously. To manage multiple tasks a server may dedicate certain computing resources, such as processor time, to tasks until those tasks are completed and results are delivered. As a specific TTS server may have multiple processors (also referred to as processing cores or hardware threads) computing resources may be discussed in terms of core percentages, which represent percentage of a processor's resources are dedicated to a certain task. In general, a task which is assigned a dedicated single core worth of resources will finish twice as fast as if the task had been assigned a half core. As an example, a TTS server with eight (8) cores may be tasked with hundreds of tasks at a time, although this number may be functionally limited to ensure assigned tasks are handled according to performance specifications (for example, time to first byte considerations).

Task prioritization by a TTS server can be complicated, particularly when computing resources are re-assigned following reception of incoming new tasks, completion of old tasks, or other situations. If resources are not assigned efficiently, for example if one TTS task is started but then a new task comes in and the first task is abandoned for a certain period of time, there is a risk that a task will reach the state of underrun. Underrun is when a TTS task in progress runs out of its backlog of synthesized speech to output and more speech needs to be processed to deliver to a user. If a tasks reaches underrun, audio playback for a user may pause for a period of time, interrupting the output of synthesized speech and creating an undesired user experience.

Offered is a system to schedule processing of TTS tasks based on a progress timer that considers how much speech has been synthesized, thus providing a measure for how long that task has before reaching underrun. The system may also prioritize processing of tasks to reduce a time to first byte. In this manner the system may schedule tasks to reduce or avoid delays or interruptions to delivering speech results to a user.

An example of the system 100 is shown in FIG. 1. As illustrated, the system may include a server TTS device 110(S) and one or more requesting mobile TTS device(s) 110(R) connected over a network 150. Although only one server and one mobile device are illustrated, the system may include many such devices. The requesting TTS device(s) 110(R) may include a variety of devices such as another server, desktop computer, laptop, tablet, mobile device, etc. The requesting TTS device(s) may be local to a user or may be in a different location. A user may operate a TTS device 110(R) and initiate a TTS request at the requesting TTS device 110(R). The request may also be initiated without user intervention. The TTS request is sent to the server TTS device 110(S) over the network 150. The server TTS device 110(S) receives the request, as shown in block 122. The server 110(S) then determines the progress time of pending TTS tasks, as shown in block 124. As described below, progress time may be calculated in a number ways and may include a calculation of the amount of synthesized speech of a task that has been output, the time since origination of the TTS task, or other factors. The server may then allocate computing resources to pending TTS tasks using the progress time, as shown in block 126 and process the tasks, as shown in block 128. As tasks are processed, the system may continue to determine the progress time, re-allocate resources, and process tasks. Described below is a system for performing TTS processing according to aspects of the present disclosure.

Figure 2:
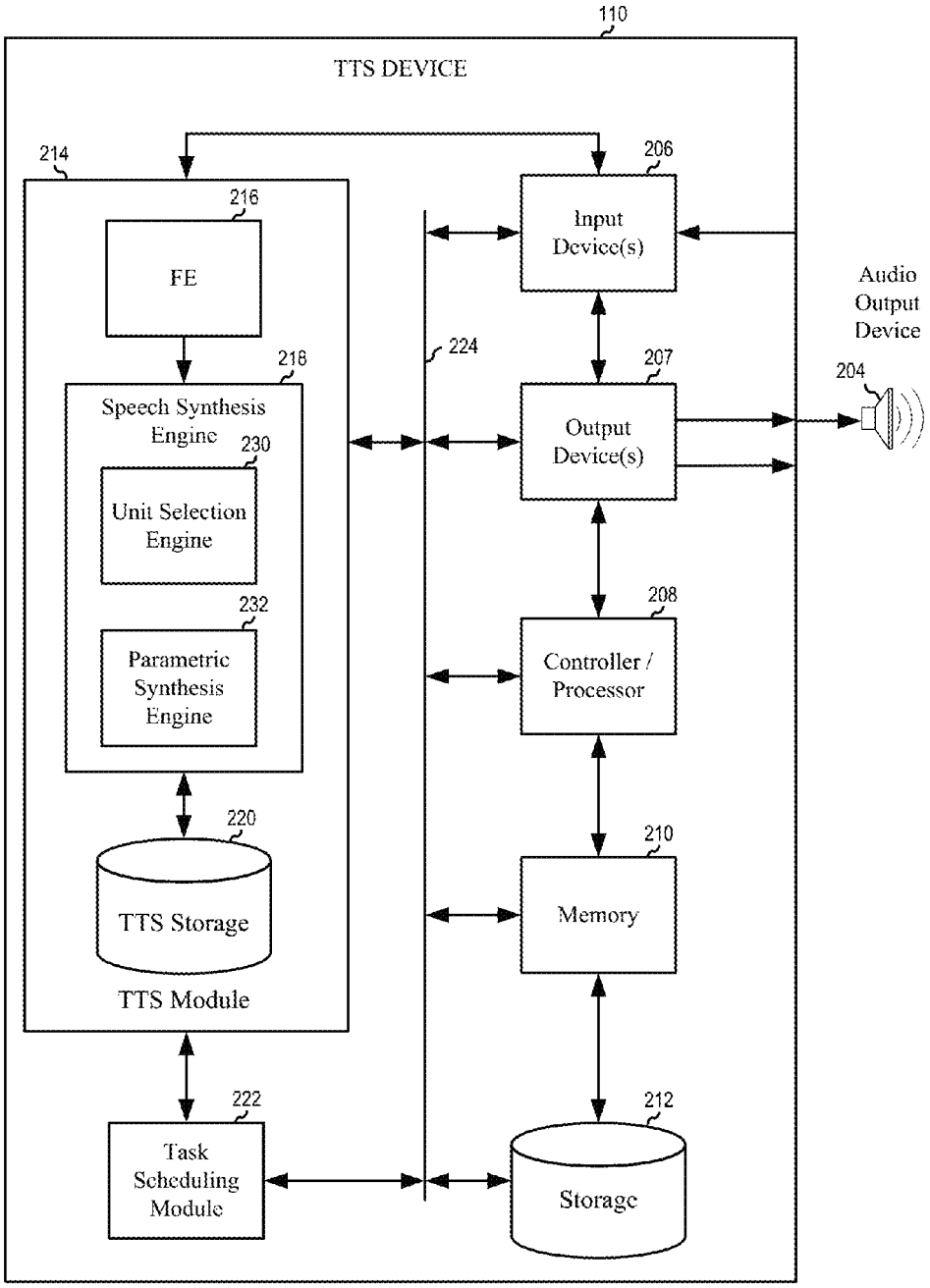
FIG. 2 is a block diagram conceptually illustrating a device for text-to-speech processing according to one aspect of the present disclosure.

FIG. 2 shows a text-to-speech (TTS) device 110 for performing speech synthesis. The TTS device 110 may be a requesting TTS device 110(R), a server TTS device 110(S), or another TTS device. Aspects of the present disclosure include computer-readable and computer-executable instructions that may reside on the TTS device 110. FIG. 2 illustrates a number of components that may be included in the TTS device 110, however other non-illustrated components may also be included. Also, some of the illustrated components may not be present in every device capable of employing aspects of the present disclosure. Further, some components that are illustrated in the TTS device 110 as a single component may also appear multiple times in a single device. For example, the TTS device 110 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 110 may also be a component of other devices or systems that may provide speech recognition functionality such as automated teller machines (ATMs), kiosks, global position systems (GPS), home appliances (such as refrigerators, ovens, etc.), vehicles (such as cars, buses, motorcycles, etc.), and/or ebook readers, for example.

As illustrated in FIG. 2, the TTS device 110 may include an audio output device 204 for outputting speech processed by the TTS device 110 or by another device. The audio output device 204 may include a speaker, headphone, or other suitable component for emitting sound. The audio output device 204 may be integrated into the TTS device 110 or may be separate from the TTS device 110. The TTS device 110 may also include an address/data bus 224 for conveying data among components of the TTS device 110. Each component within the TTS device 110 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 110 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 110 may also include a data storage component 212, for storing data and instructions. The data storage component 212 may include one or more storage types such as magnetic storage, optical storage, solid-state storage, etc. The TTS device 110 may also be connected to removable or external memory and/or storage (such as a removable memory card, memory key drive, networked storage, etc.) through the input device 206 or output device 207. Computer instructions for processing by the controller/processor 208 for operating the TTS device 110 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 110 includes input device(s) 206 and output device(s) 207. A variety of input/output device(s) may be included in the device. Example input devices include an audio output device 204, such as a microphone, a touch input device, keyboard, mouse, stylus or other input device. Example output devices include a visual display, tactile display, audio speakers (pictured as a separate component), headphones, printer or other output device. The input device(s) 206 and/or output device(s) 207 may also include an interface for an external peripheral device connection such as universal serial bus (USB), FireWire, Thunderbolt or other connection protocol. The input device(s) 206 and/or output device(s) 207 may also include a network connection such as an Ethernet port, modem, etc. The input device(s) 206 and/or output device(s) 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device(s) 206 and/or output device(s) 207 the TTS device 110 may connect to a network, such as the Internet or private network, which may include a distributed computing environment.

The device may also include an TTS module 214 for processing textual data into audio waveforms including speech. The TTS module 214 may be connected to the bus 224, input device(s) 206, output device(s) 207, audio output device 204, controller/processor 208 and/or other component of the TTS device 110. The textual data may originate from an internal component of the TTS device 110 or may be received by the TTS device 110 from an input device such as a keyboard or may be sent to the TTS device 110 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech.

The FE 216 and speech synthesis engine 218 may include their own controller(s)/processor(s) and memory or they may use the controller/processor 208 and memory 210 of the TTS device 110, for example. Similarly, the instructions for operating the FE 216 and speech synthesis engine 218 may be located within the TTS module 214, within the memory 210 and/or storage 212 of the TTS device 110, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 110 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word may be mapped to one or more phonetic units. Such mapping may be performed using a language dictionary stored in the TTS device 110, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 110 with many different options for concatenating units into speech. One benefit of unit selection is that, depending on the size of the database, a natural sounding speech output may be generated. The larger the unit database, the more likely the TTS device 110 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parameterized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGHT vocoder, HNM (harmonic plus noise) based vocoders, CELP (code-excited linear prediction) vocoders, GlottHMM vocoders, HSM (harmonic/stochastic model) vocoders, or others.

Figure 3:
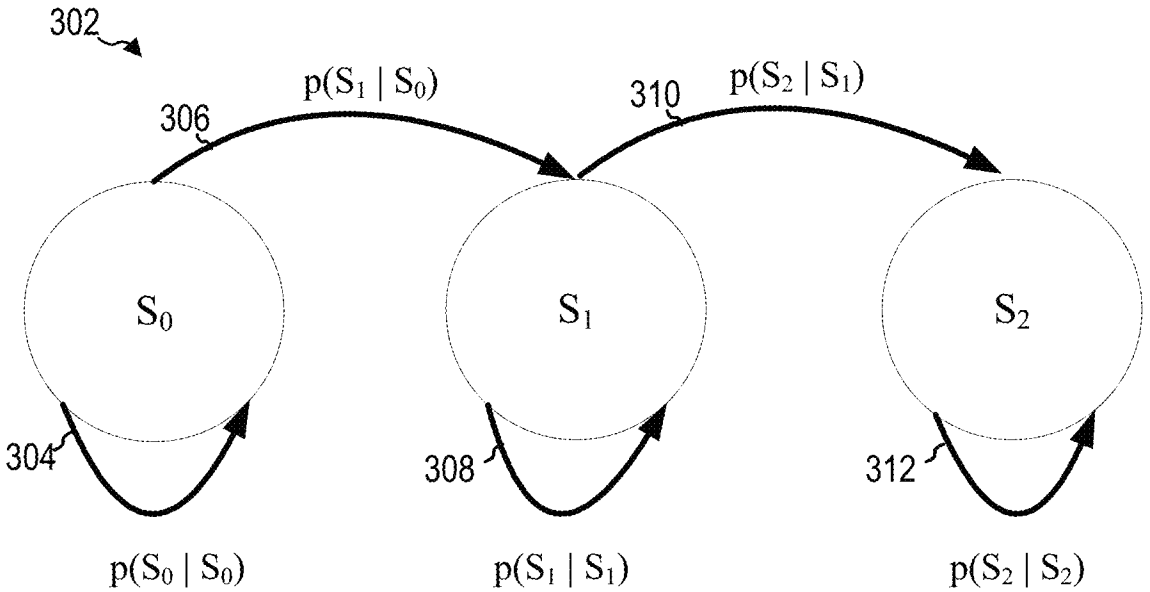
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 230 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 110 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 110. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output.

Figure 4A:
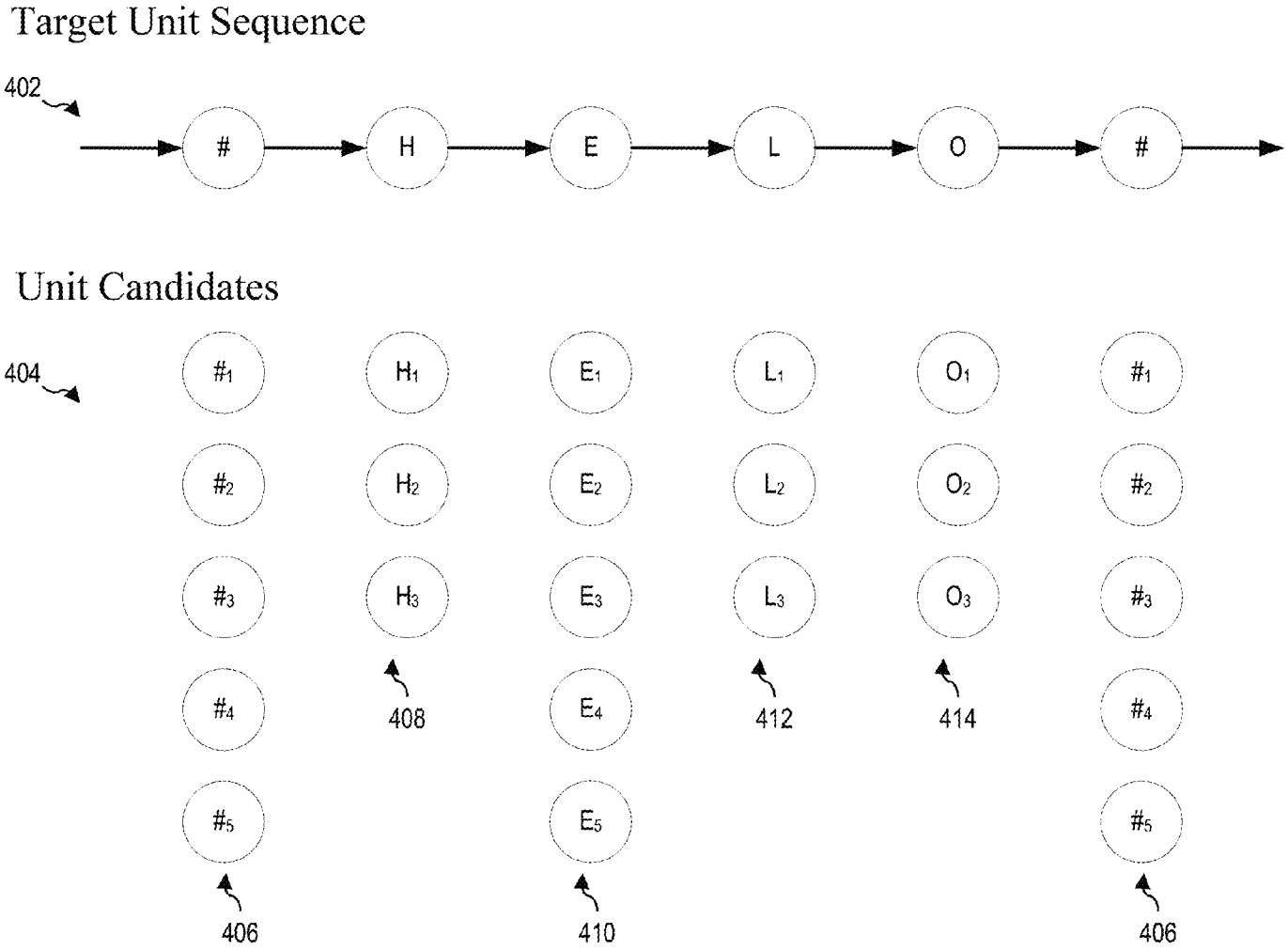
FIGS. 4A-4B illustrate speech synthesis using unit selection according to one aspect of the present disclosure.
Figure 4B:
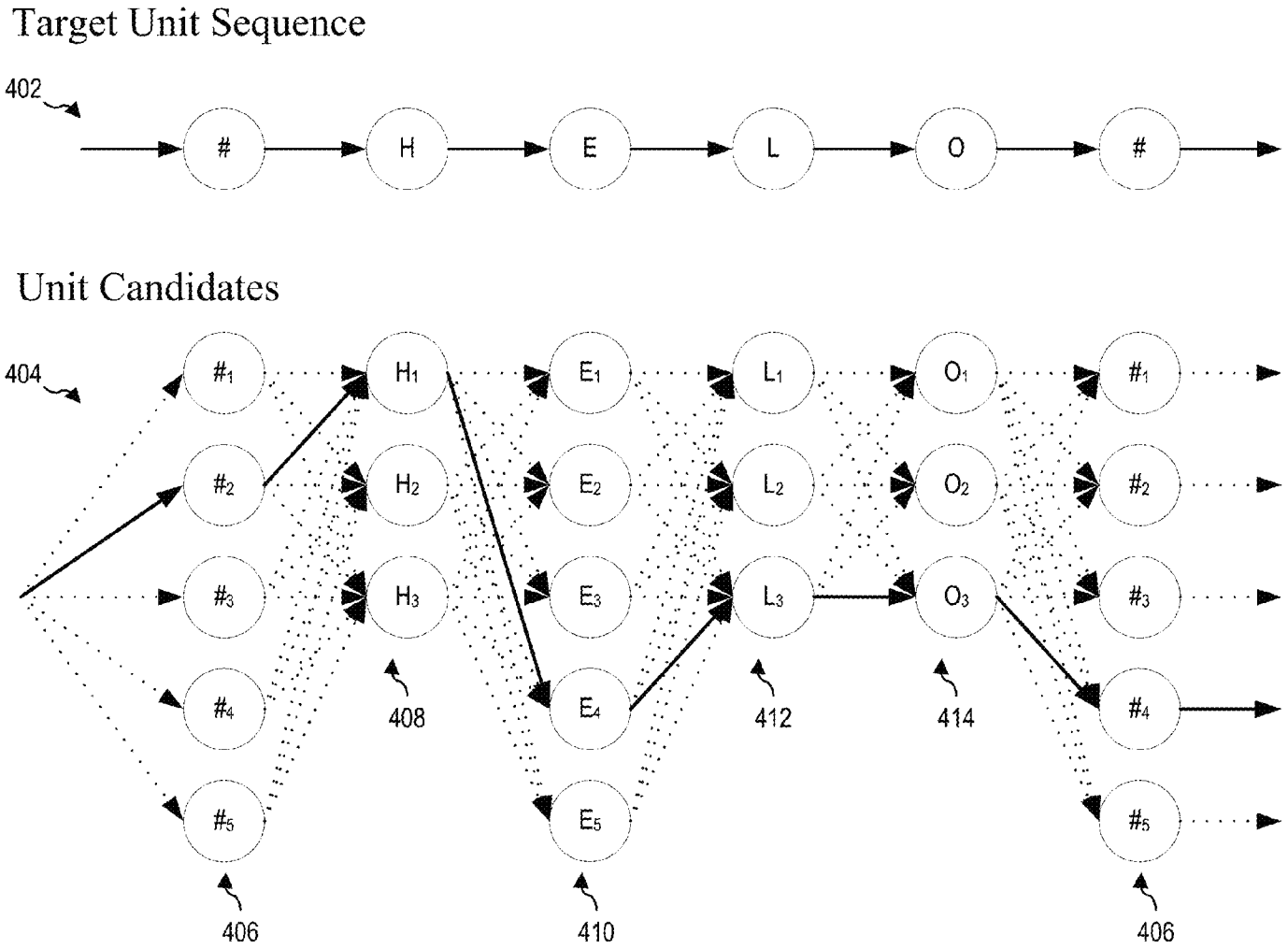

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings. An example of this graph is shown in FIG. 4B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 4B the selected path is represented by the solid line. Thus units $\#_2$, $H_1$, $E_4$, $L_3$, $O_3$, and $\#_4$ may be selected to synthesize audio for the word "hello."

Audio waveforms including the speech output from the TTS module 214 may be sent to an audio output device 204 for playback to a user or may be sent to the output device 207 for transmission to another device, such as another TTS device 110, for further processing or output to a user. Audio waveforms including the speech may be sent in a number of different formats such as a series of feature vectors, uncompressed audio data, or compressed audio data. For example, audio speech output may be encoded and/or compressed by an encoder/decoder (not shown) prior to transmission. The encoder/decoder may be customized for encoding and decoding speech data, such as digitized audio data, feature vectors, etc. The encoder/decoder may also encode non-TTS data of the TTS device 110, for example using a general encoding scheme such as .zip, etc. The functionality of the encoder/decoder may be located in a separate component or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 110 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
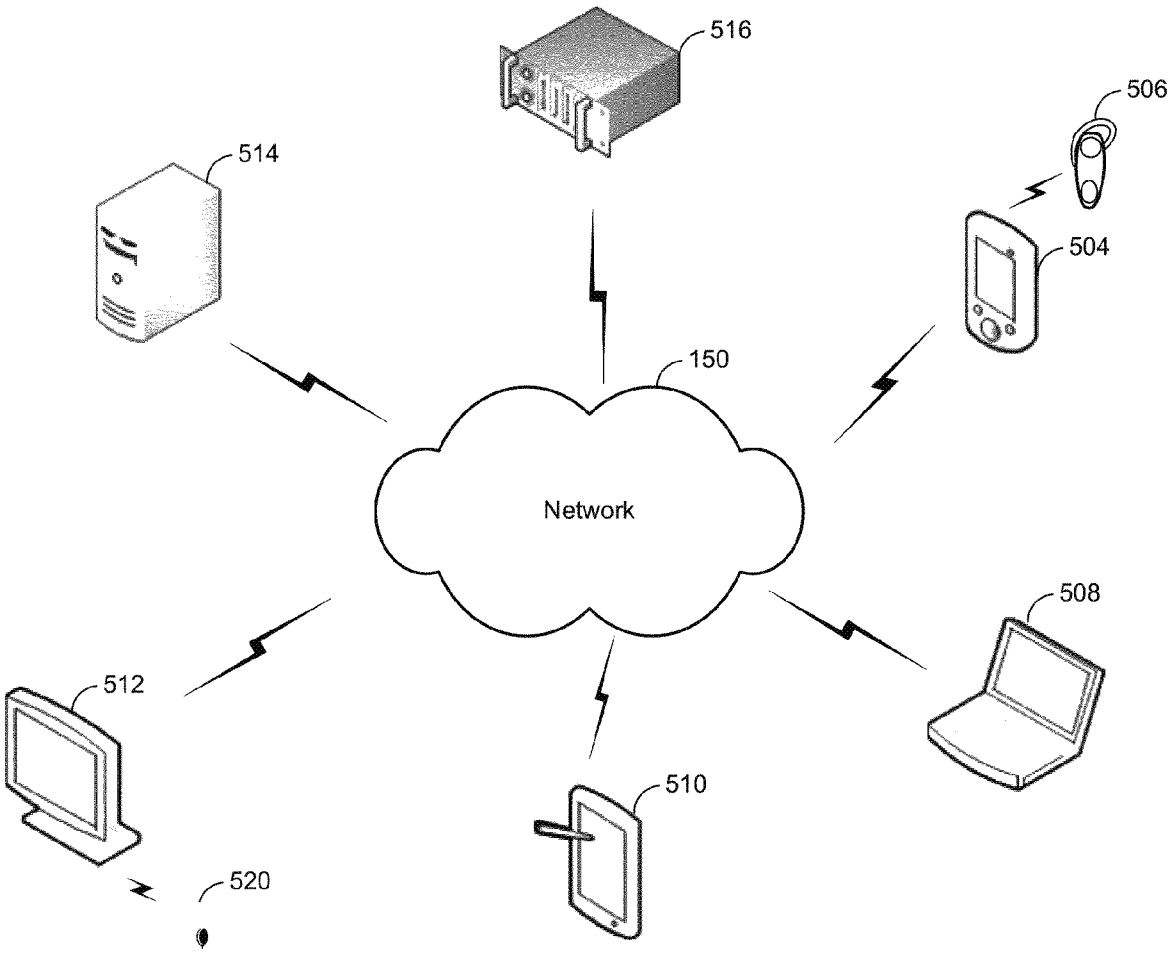
FIG. 5 illustrates a computer network for use with text-to-speech processing according to one aspect of the present disclosure.

Multiple TTS devices 110 may be connected over a network. As shown in FIG. 5 multiple devices (which each may be a TTS device 110 or include components thereof) may be connected over network 150. Network 150 may include a local or private network or may include a wide network such as the internet. Devices may be connected to the network 150 through either wired or wireless connections. For example, a wireless device 504 may be connected to the network 150 through a wireless service provider. Other devices, such as computer 512, may connect to the network 150 through a wired connection. Other devices, such as laptop 508 or tablet computer 510 may be capable of connection to the network 150 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 150. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

In one aspect, a remote TTS device may be configured with a task scheduling module 222 as shown in FIG. 2. The task scheduling module 222 may schedule TTS tasks to avoid underrun and other undesired effects, such as a long time to first byte. The task scheduling module 222 may be incorporated into a remote TTS device, such as a TTS server, which processes TTS requests. The task scheduling module may schedule TTS tasks and assign computing resources as described below.

In scheduling TTS tasks and computing resources for processing those tasks, it is desirable for the system to reduce user noticeable delays or interruptions, such as those caused by long times to first byte, underrun, etc. Further, it is desirable to handle new incoming TTS tasks efficiently and to be able to reject tasks for processing by another server or device if the new task cannot be handled without causing such interruptions. Further, it is desirable to make efficient use of computing resources and to not have computing resources idle that may otherwise be dedicated to processing TTS tasks.

Certain TTS tasks may process faster than other tasks depending on various factors such as the selected voice for synthesis, content of the text, etc. Considering these many factors when scheduling TTS tasks and computing resources may be difficult and inefficient. To simplify TTS task scheduling a new factor is introduced, one that considers how close the task is to reaching underrun. Tasks may then be scheduled based on this factor to improve TTS system performance.

For each incoming TTS task, the system may note the origination time of the task. This origination time may be the time that the user first submitted the TTS request to the TTS system, the time the TTS task first arrived at the TTS system, the time the first portion of audio results of the TTS request have been sent to the user, or some other point in time. The time to first byte may also be measured from a number of different points, including those discussed above. If the origination time is determined by a device other than the device that will perform the TTS processing, a synchronization operation may synchronize time among the devices so that time may be tracked consistently across various components of the TTS system.

Once the origination time is noted the system may then calculate the time since origination for a TTS task. The time since origination is simply the current time minus the origination time.

Once processing on the TTS task has started, the TTS system may also calculate the amount of synthesized speech processed for the TTS task. That calculated amount of synthesized speech may include only synthesized speech that has been sent to the user or may also include synthesized speech that is buffered in the TTS system and is awaiting output to the user. The amount of time it would take to playback a task's already processed synthesized speech (for example, synthesized speech that has been sent to the user) may be considered the amount of delivered speech, measured in how long it would take to play back the delivered speech in units of time (such as ms). This playback time may be determined by the TTS system based on the amount of synthesized speech using known calculation or estimation techniques. By comparing the amount of delivered speech to the time since origination, the system may arrive at one measurement of the user experience, specifically how close the system may be to underrun for a particular user.

Thus, using the above time measurements the system may calculate what is referred to here as a task's progress time. The progress time may be calculated as shown in Equation 1:

$$\text{Progress Time} = \text{Amount of Delivered Speech} - \text{Time Since Origination} \quad (1)$$

Each TTS task may be associated with a progress time. The progress time for each task may also be dynamically updated to reflect the changing value of time since origination (as the current time changes) and of the amount of delivered speech (which will increase as more speech is synthesized and sent to the user). By calculating progress time in the above manner, and allocating system resources based on progress time (discussed below), the system may account for speech delivery from the point of view of the user and may allocate resources when the amount of speech delivered to the user falls below a satisfactory threshold. Other methods of calculating progress time are also possible. For the remainder of the description, however, the examples presented illustrate system operation using the calculation of progress time as shown above in Equation 1.

Once a TTS request is received by the TTS system, a certain amount of pre-processing may be performed by the system as described above before the first segments of speech are synthesized and output. This pre-processing and other factors such as transmission delays may determine the time to first byte. The TTS system may track the time to first byte for certain tasks. The TTS system may also track whether TTS processing has started for certain tasks, even if no speech has yet been synthesized. During this time of pre-processing the progress time may have a negative value as the time since origination is positive but the amount of delivered speech=0. (Although amount of delivered speech may=0 prior to speech synthesis, underrun has not yet been reached as speech output has not yet started.) Once speech synthesis begins, however, the progress time should have a positive value within a short time as speech synthesis and output proceeds quickly. If the progress time of Equation 1 approaches 0 and/or a negative value after speech synthesis has been underway, then it may be an indication that a task is approaching underrun, and system computing and/or delivery resources should be allocated to avoid underrun.

Figure 6:
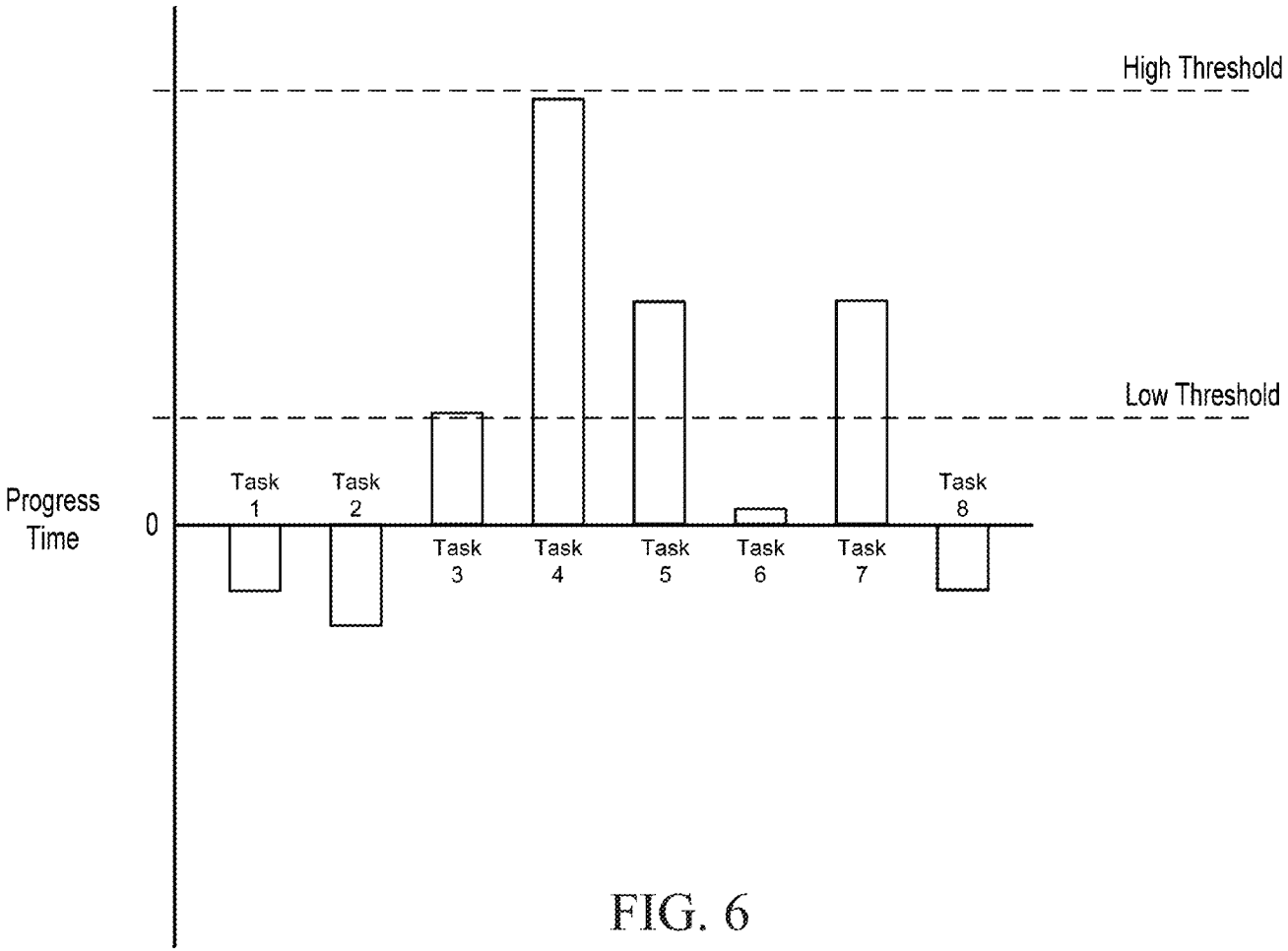
FIG. 6 illustrates TTS task progress time according to one aspect of the present disclosure.

The TTS system may prioritize the processing of TTS tasks using the progress time, where tasks with the lowest progress time may receive the highest processing priority for purposes of allocating computing resources. FIG. 6 illustrates a series of TTS tasks (Tasks 1-8) and their respective progress times. As shown, Tasks 1, 2, and 8 have negative process times, indicating that the system has either yet to begin synthesizing speech for those tasks, or the amount of synthesized speech for those tasks is still small. Tasks 3-7 have a positive progress time, indicating that speech synthesis has begun and that a certain amount of backlog speech exists for these tasks. The TTS system may prioritize processing of the tasks with negative values of progress time, in particular Tasks 1, 2, and 8, over Tasks 3-7.

The TTS system may, however, determine that tasks with low positive values of progress time are deserving of higher priority than tasks with negative values of progress time. For example, as shown in FIG. 6, Task 6 has a positive value of progress time, but is approaching 0, indicating that the delivered speech for Task 6 is about to run out. If the TTS system places a high priority in ensuring that a task should avoid underrun, it may prioritize processing of Task 6 above the tasks that have not yet started to make sure Task 6 does not reach underrun.

The TTS system may reallocate computing resources to tasks on a regular basis (such as every x ms, after a chunk of speech is synthesized or other data produced, after another task state change) or upon a triggering activity. For example, every time a new TTS task is sent to the TTS system the TTS system may be triggered to evaluate the priority of each assigned task and to reallocate computing resources accordingly.

As another example, when a progress time for a specific task crosses a certain threshold, that may trigger the TTS system to reallocate resources. For example, as shown in FIG. 6 a low threshold progress time may exist. If the progress time of a particular task crosses this low threshold, the TTS system may be triggered to reallocate resources. For example, as shown in FIG. 6, Task 3 may drop below the low threshold if no further speech is currently being synthesized and/or output for Task 3 due to other tasks occupying the TTS server. Once the progress time of Task 3 passes below the low threshold, the TTS server may allocate computing resources to process and output the speech of Task 3 to ensure that its progress time returns to above the low threshold. In another aspect, the low threshold may depend on whether there is any further speech to synthesize for the particular task. For example, if the server has completed speech synthesis and output for Task 3, Task 3 passing the low threshold may not trigger the TTS system to reallocate computing resources.

The TTS system may also employ a high threshold in cases where the system may desire to keep a synthesized speech backlog and/or progress time below a certain value. In this case the TTS system may reallocate computing resources when a certain task's progress time (for example Task 4 in FIG. 6) reaches the high threshold. The thresholds described above (or others used by the system) may be dynamic depending on various system conditions. The thresholds may also be different for different tasks, where each task may be assigned one or more customized thresholds.

A TTS server may allocate computing resources in a number of ways. In one aspect, the TTS server may allocate a single core to a single task and concentrate its processing on the highest priority TTS tasks, as judged by progress time. For example, for an 8 core server, the server may process the 8 TTS tasks with the lowest progress time (i.e., highest priority). This allocation of computing resources may continue until a timer expires or a triggering event occurs. When the server completes a TTS task (such as by completing speech synthesis for the task, completing output of audio of the task, etc.), reallocation/reprioritization may be triggered and the server may commence processing of a new task. The new task may be selected based on the task's priority. A TTS server may also divide core processing among multiple tasks. While assigning multiple tasks to a single core may slow the individual processing of each task it may be desirable when the system is assigned more tasks than cores. If the TTS server has more cores than tasks it may assign an unused core to build up the speech synthesis backlog of a task being processed by another core.

In one aspect, tasks may be prioritized as follows:

1. Tasks with a lower value positive progress time
2. Tasks with a negative progress time that have begun synthesis
3. Tasks with a lower value negative progress time that have not begun synthesis
4. Tasks with a higher value negative progress time that have not begun synthesis
5. Other tasks Tasks may also be prioritized in other manners determined by the TTS system.

When a TTS server is sent a potential new request the server may determine whether it has the capacity to handle the new request without negatively impacting the processing of pending tasks. In one aspect the server may simply measure its processing load and reject any new requests when its processing load exceeds a certain percentage of the maximum processing load. In another aspect the server may reject any new requests that would result in the server handling more TTS requests than the server has cores. In another aspect the TTS server may determine an average progress time among its pending tasks and if the average progress time is above a certain threshold, the TTS server may accept the new request. For example, if a large number of pending tasks have a large enough progress time, the server may accept (and dedicate resources to) new TTS tasks without necessarily approaching underrun for those already pending tasks. The TTS server may consider the average progress time of tasks that have positive values when making this determination.

In another aspect, the server may accept new tasks based on the server capacity. The server capacity may be measured as the portion of server capabilities that are occupied relative to the amount of speech the server may produce in real time, that is the amount of speech the server could synthesize to match a playback speed of the synthesized speech. For example, if a server core processing a single task may synthesize speech 10 times faster than speech playback, a server with 10 cores may process 100 TTS tasks at approximately real time speed (that is, the server may synthesize speech for 100 tasks at the same speed speech for those 100 tasks could be played back). Thus, using the above example, a 10 core server tasked with 50 tasks may have a full load, but would only be acting at approximately 50% real time capacity. Thus this server, if assigned a new TTS task, could accept the task without exceeding its capacity.

In another aspect, the server may accept new tasks based on processing speed, as measured by the change in the progress time of a task (or of a group of tasks) over a time period as compared to the real time playback time for the synthesized speech. For example, a server may be capable of synthesizing currently assigned TTS tasks at 1.5 times faster than real time. (This speed represents an average processing speed for the server's currently assigned TTS tasks.) The percentage of the server's real time capacity (that is, the ability of the server to synthesize speech for multiple tasks at the same playback rate of the synthesized speech) may be represented as a percentage of the inverse of the processing speed. For example, 1/1.5=66%, meaning the server is handling approximately 66% of its real time capacity. Depending on this capacity number and the estimated value of server resource consumption for a new TTS task (which may depend on, for example, voice type of the new TTS task), the server may decide if it can take a new TTS task without exceeding 100% of capacity. As an extension of this calculation, a new TTS task to be synthesized at full speed (i.e., assigned to a dedicated core) may be given an estimated resource consumption represented by 1 divided by the number of server cores*100%. Thus a new high priority TTS task may be represented as taking 10% of a 10 core server's capacity. The server may consider this number when determining whether to accept a new TTS task.

Other techniques may also be used to determine when a TTS server may accept new incoming requests. If the server determines that it should not accept a new task the potential new request may be rejected and assigned to a different server. When a new task is accepted by the TTS server a reprioritization of tasks and reallocation of computing resources may be triggered. New tasks may be given a high priority by the TTS server so as to reduce the time to first byte of a new request.

Figure 7:
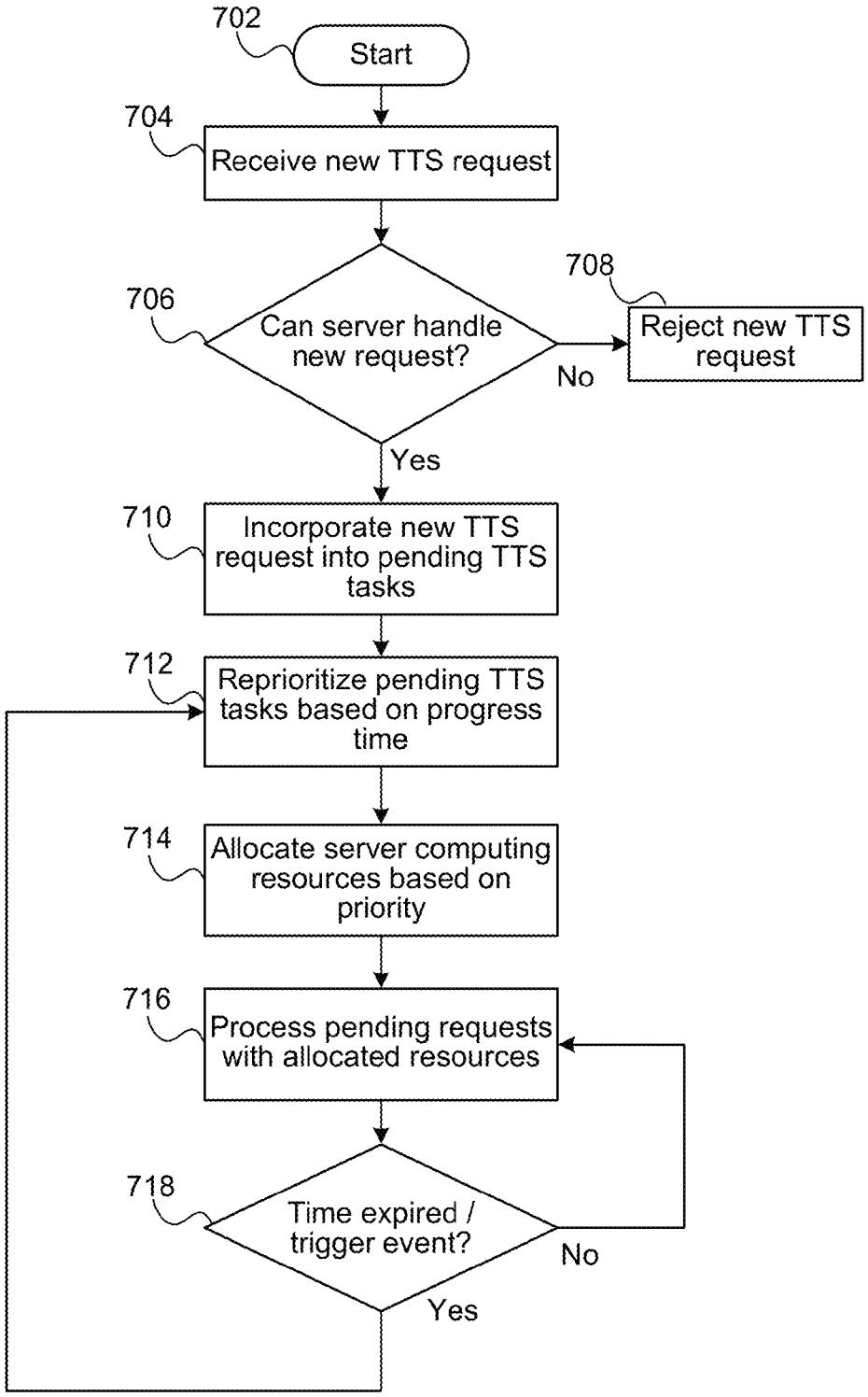
FIG. 7 illustrates allocating resources to TTS tasks according to one aspect of the present disclosure.

FIG. 7 illustrates a flow diagram for an example process of resource allocation according to one aspect of the present disclosure. The flowchart starts at block 702, when the TTS system may be processing pending TTS requests. A new request arrives, as shown at block 704. The system then determines if the assigned TTS server can handle the new request, as shown at block 706. If the server cannot handle the request, the request is rejected, as shown in block 708. If the server can handle the request, the new request is incorporated into the list of pending TTS tasks assigned to the server, as shown in block 710. The system then may reprioritize pending TTS tasks assigned to the server based on progress time, as shown in block 712. The system may then allocate server computing resources to the pending TTS tasks based on the priority, as shown in block 714. The server then continues to process pending requests with the allocated resources, as shown in block 716. If no trigger events occur, or no timer expires to trigger a reprioritization, as checked in block 718, the server continues to process the TTS request. If a prioritization timer expires, or if a trigger event occurs (such as receiving a new request, completing a task, a task progress time crossing a threshold, etc.) the system may reprioritize tasks as shown in block 712 and continue processing. These steps may be performed by various components of the TTS system, including the TTS module 214, task scheduling module 222, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A method of allocating resources in a text-to-speech (TTS) processing server, the method comprising:

processing a first TTS task;

processing a second TTS task;

determining an origination time for the first TTS task;

determining, using the origination time for the first TTS task, a time since origination of the first TTS task;

determining, for the first TTS task, a first playback time for an amount of output synthesized speech corresponding to the first TTS task;

determining a first progress time for the first TTS task, the first progress time being the first playback time minus the time since origination of the first TTS task;

determining an origination time for the second TTS task;

determining, using the origination time for the second TTS task, a time since origination of the second TTS task;

determining, for the second TTS task, a second playback time for an amount of output synthesized speech corresponding to the second TTS task;

determine a second progress time for the second TTS task, the second progress time being the second playback time minus the time since origination of the second TTS task;

receiving a third TTS task;

determining an origination time for the third TTS task;

determining, using the origination time for the third TTS task, a time since origination of the third TTS task; and determining an allocation of computing resources among the first TTS task, the second TTS task and the third TTS task based at least in part on the first progress time, the second progress time, and the time since origination of the third TTS task.

2. The method of claim 1, further comprising assigning the first TTS task a higher priority for allocation of computing resources than the second TTS task in response to the first progress time being less than the second progress time.

3. The method of claim 1, further comprising assigning the first TTS task a highest priority for allocation of computing resources based on the first progress time falling below a threshold.

4. A computing system, comprising:

at least one processor;

at least one memory component including instructions operable to be executed by the at least one processor to perform a set of actions, the instructions configuring the at least one processor:

to determine an origination time for a text-to-speech (TTS) task;

to determine, using the origination time, a time since origination of the TTS task;

to determine a playback time for an amount of output synthesized speech corresponding to the TTS task; and to allocate computing resources to process the TTS task based on both the playback time and time since origination.

5. The computing system of claim 4, wherein the instructions further configure the at least one processor:

to determine a progress time for the TTS task, the progress time being the playback time minus the time since origination, and wherein the at least one processor is configured to allocate computing resources based at least in part on the progress time.

6. The computing system of claim 5, wherein the instructions further configure the at least one processor:

to determine an origination time for a second TTS task;

to determine, using the origination time for the second TTS task, a second time since origination, the second time since origination being a time since origination of the second TTS task;

to determine a second playback time for an amount of output synthesized speech corresponding to the second TTS task;

to determine a second progress time for the second TTS task, the second progress time being the second playback time minus the second time since origination; and to prioritize allocation of computing resources to the TTS task above allocation of computing resources to the second TTS task based on the progress time being less than the second progress time.

7. The computing system of claim 5, wherein the instructions further configure the at least one processor:

to process a plurality of TTS tasks, the plurality of TTS tasks including the TTS task; and to determine a new allocation of computing resources to the plurality of TTS tasks based on the progress time dropping below a threshold.

8. The computing system of claim 7, wherein the new allocation comprises assigning the TTS task a highest priority among the plurality of TTS tasks.

9. The computing system of claim 4, wherein the instructions further configure the at least one processor:

to process a plurality of TTS tasks, the plurality of TTS tasks including the TTS task; and to determine a new allocation of computing resources to the plurality of TTS tasks based on the playback time dropping below a threshold.

10. The computing system of claim 4, wherein the instructions further configure the at least one processor:

to estimate a server metric, wherein the server metric represents a comparison of speech synthesized by a server and an amount of time to play back the speech synthesized by the server;

to receive a request to process a new TTS task; and to accept the new TTS task based at least in part on the server metric.

11. The computing system of claim 10, wherein the instructions further configure the at least one processor to accept the new task in response to an average processing speed for TTS tasks handled by the server being greater than a playback time for all speech synthesized for the TTS tasks handled by the server.

12. The computing system of claim 11, wherein the instructions further configure the at least one processor to estimate a portion of server capacity to be dedicated to the new TTS task based on a number of processors of the server, and wherein the at least one processor accepts the new TTS task further based at least in part on the portion of server capacity to be dedicated to the new TTS task.

13. A computer-implemented method comprising:

determining an origination time for a text-to-speech (TTS) task;

determining, using the origination time, a time since origination of the TTS task;

determining a playback time for an amount of output synthesized speech corresponding to the TTS task; and allocating computing resources to process the TTS task based on both the playback time and time since origination.

14. The computer-implemented method of claim 13, further comprising:

determining a progress time for the TTS task, the progress time being the playback time minus the time since origination, and wherein the program code to allocate computing resources is based at least in part on the progress time.

15. The computer-implemented method of claim 14, further comprising:

determining an origination time for a second TTS task;

determining, using the origination time for the second TTS task, a second time since origination, the second time since origination being a time since origination of the second TTS task;

determining a second playback time for an amount of output synthesized speech corresponding to the second TTS task;

determining a second progress time for the second TTS task, the second progress time being the second playback time minus the second time since origination; and prioritizing allocation of computing resources to the TTS task above allocation of computing resources to the second TTS task based on the progress time being less than the second progress time.

16. The computer-implemented method of claim 14, further comprising:

processing a plurality of TTS tasks, the plurality of TTS tasks including the TTS task; and determining a new allocation of computing resources to the plurality of TTS tasks based on the progress time dropping below a threshold.

17. The computer-implemented method of claim 16, wherein the new allocation comprises assigning the TTS task a highest priority among the plurality of TTS tasks.

18. The computer-implemented method of claim 13, further comprising:

processing a plurality of TTS tasks, the plurality of TTS tasks including the TTS task; and determining a new allocation of computing resources to the plurality of TTS tasks based on the playback time dropping below a threshold.

19. The computer-implemented method of claim 13, further comprising:

estimating a server metric, wherein the server metric represents a comparison of speech synthesized by a server and an amount of time to play back the speech synthesized by the server;

receiving a request to process a new TTS task; and accepting the new TTS task based at least in part on the server metric.

20. The computer-implemented method of claim 19, wherein accepting the new TTS task is based on an average processing speed for TTS tasks handled by the server being greater than a playback time for all speech synthesized for the TTS tasks handled by the server.

21. The computer-implemented method of claim 20, further comprising:

estimating a portion of server capacity to be dedicated to the new TTS task based on a number of processors of the server, and wherein the program code to accept the new TTS task is further based at least in part on the portion of server capacity to be dedicated to the new TTS task.

* * * * *